US006176719B1

(12) United States Patent
Williams et al.

(10) Patent No.: US 6,176,719 B1
(45) Date of Patent: Jan. 23, 2001

(54) BOLTED ELECTRICAL CONNECTING DEVICE FOR MULTIPLE ELECTRICAL CONDUCTORS

(75) Inventors: Patrick Williams, Raleigh, NC (US); Rodney J. West, Liberty, IN (US); Daniel L. Wittmer, Fairfield; Glen S. O'Nan, Hamilton, both of OH (US)

(73) Assignee: Square D Company, Palatine, IL (US)

( * ) Notice: Under 35 U.S.C. 154(b), the term of this patent shall be extended for 0 days.

(21) Appl. No.: 09/065,849

(22) Filed: Apr. 24, 1998

(51) Int. Cl.[7] ..... H01R 4/60
(52) U.S. Cl. ..... 439/213; 439/213
(58) Field of Search ..... 439/213, 210, 439/873, 211, 212, 115, 359, 657, 686, 690, 691, 694, 695, 696, 725, 727, 728, 729, 731, 733.1, 738, 750, 751, 752, 781, 782, 793, 794, 811; 174/88 B, 99 B

(56) References Cited

U.S. PATENT DOCUMENTS 3,541,224 * 11/1970 Joly ..... 174/72 C
4,310,209 * 1/1982 Fleming et al. ..... 439/99
4,585,092 * 4/1986 Lu ..... 362/413
4,643,512 * 2/1987 Prodel ..... 439/412
4,684,196 * 8/1987 Smith et al. ..... 439/411
4,964,813 * 10/1990 Francois et al. ..... 439/521
4,985,003 * 1/1991 Francois et al. ..... 439/781
5,266,044 * 11/1993 Whitney et al. ..... 439/210
5,399,095 * 3/1995 West et al. ..... 439/320
5,415,558 * 5/1995 Baker ..... 439/210
5,484,300 * 1/1996 Whitney et al. ..... 439/207
5,516,302 * 5/1996 Kim et al. ..... 439/210

* cited by examiner

*Primary Examiner*—Paula Bradley
*Assistant Examiner*—Ross Gushi
(74) *Attorney, Agent, or Firm*—David R. Stacey; Larry I. Golden; Larry T. Shrout

(57) ABSTRACT

The present invention provides a device for electrically connecting electrical conductors of two adjacent sections of a multi-phase electrical distribution system. The connecting device includes a generally cylindrical body enclosing two ground connectors, two outside insulators and two inside insulators intermediate the outside insulators. Each of the outside and inside insulators includes an equal number of semi-circular shaped electrical connectors which are arranged such that each electrical connector on one of the outside insulators has a corresponding electrical connector on one of the inside insulators thus forming a pocket. Each pocket receives one electrical conductor from each of the two adjacent sections of the electrical distribution system. Electrical conductors of the two adjacent sections of the electrical distribution system sharing a common pocket are electrically connected by the corresponding electrical connectors forming that pocket as the two outside insulators are drawn toward the two inside insulators.

20 Claims, 6 Drawing Sheets

BOLTED ELECTRICAL CONNECTING DEVICE FOR MULTIPLE ELECTRICAL CONDUCTORS

FIELD OF THE INVENTION

This invention relates to connections for electrical distribution systems employing cable or round solid conductors and more specifically to a bolted electrical connector for multi-phase electrical distribution systems having generally round conductors.

BACKGROUND OF THE INVENTION

Electrical connections between two adjacent sections of a multi-phase electrical distribution system having round conductors have been made by spring loaded connectors or by a separate bolted connection for each phase of the distribution system that requires additional space for the connection and electrical insulation required to separate the different phases. While spring loaded connections are easily assembled and can be compact in size, there are times when a bolted connection is preferred or required in an area where limited space is available. It is also desirable that a protective housing surrounding the electrical connection be compact and easily converted to a water resistant housing when mated to adjacent sections of a pre-bussed conduit electrical distribution system or electrical metallic tubing.

SUMMARY OF THE INVENTION

The electrical connector of the present invention provides a means for electrically connecting the round conductors of adjacent sections of a multi-phase electrical distribution system within a limited space. The connector device includes a generally cylindrical housing enclosing two outside insulators and two inside insulators which are clamped together by two connector bolts. An equal number of electrical connectors are fixed to each of the outside and inside insulators, such that, for each electrical connector on one of the outside insulators, there is a corresponding electrical connector on one of the inside insulators. Each pair of corresponding electrical connectors form a pocket for receiving an end of one of the electrical conductors from each of the two adjacent sections of the electrical distribution system. As the connector bolts are tightened, a uniform pressure is applied to the outside insulators through spring washers on the connector bolts. This uniform pressure causes the corresponding electrical connectors forming the pockets to be tightly clamped against the ends of the electrical conductors received within the pockets, thereby making an electrical connection between the conductors of the two adjacent sections of the electrical distribution system. Sealing gaskets can be applied to the housing to provide a water resistant environment for the electrical connection.

Other features and advantages of the invention will become apparent to those skilled in the art upon review of the following detailed description, claims and drawings.

Figure 1:
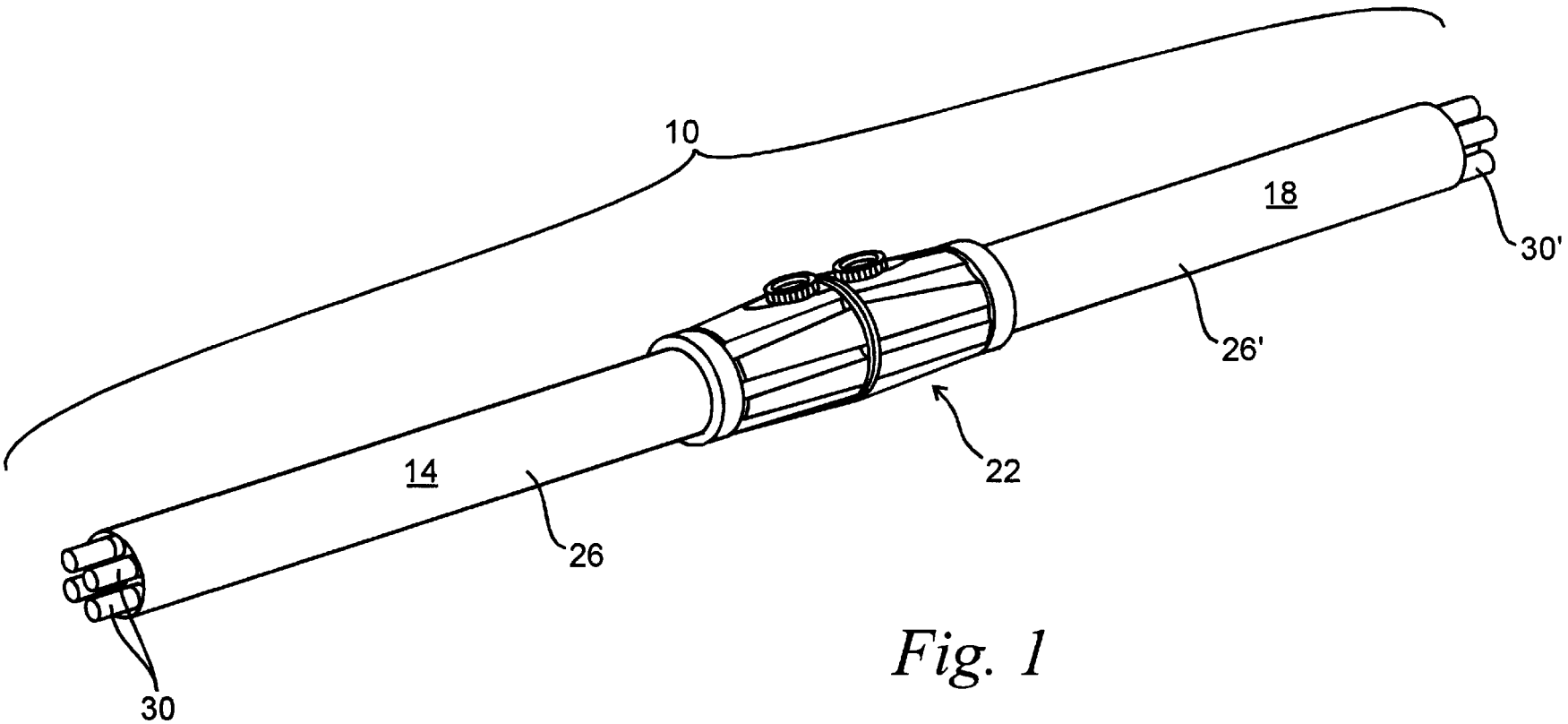
FIG. 1 is an isometric view of a sectionalized electrical distribution system employing a bolted electrical connecting device in accordance with the present invention.

Before one embodiment of the invention is explained in detail, it is to be understood that the invention is not limited in its application to the details of construction and description or illustrated in the drawings. The invention is capable of other embodiments and of being practiced or being carried out in various other ways. Also, it is to be understood that the phraseology and terminology used herein is for the purpose of description and should not be regarded as limiting.

DESCRIPTION OF THE PREFERRED EMBODIMENT

FIG. 1 illustrates the basic components of an electrical distribution system, generally indicated by reference numeral 10. The distribution system 10 is comprised of a number of individual sections connected together to form a complete system. For simplicity, the description of the preferred embodiment will discuss only a first section 14, a second section 18 and an intermediate connecting device 22 of the present invention. Each of the first and second sections, 14 and 18 respectively, includes a housing 26 and 26' for substantially enclosing a number of individually insulated electrical conductors 30 and 30'. The housings 26 and 26' are preferably tubular in shape and electrically conductive such that the system ground current can be carried by the housings 26/26'. The connecting device 22 of the present invention, provides a means for electrically connecting the adjacent ends of electrical conductors 30 and 301 and the ground current carrying housings 26 and 26' of the first and second sections, 14 and 18, respectively. The connecting device 22 also provides a mechanical connection between the first and second sections, 14 and 18, respectively. An electrical distribution system of this type generally include one electrical conductor, 30 or 30' for each electrical phase of the distribution system 10. In the preferred embodiment these conductors 30/30' are substantially rigid and generally circular in cross-section. However, multiple individually insulated cables enclosed within a common housing could also be electrically connected by the connector 22. To facilitate installation, the electrical distribution system 10 may be sectionalized, as shown in FIG. 1, wherein one end of the first section 14 is immediately adjacent to one end of the second section 18. The electrical connecting device 22 is positioned between the two adjacent ends of the first and second sections, 14 and 18 respectively, such that the adjacent ends of the electrical conductors 30 and 30' from the first and second sections, 14 and 18 respectively, may be received within the electrical connecting device 22.

Figure 2:
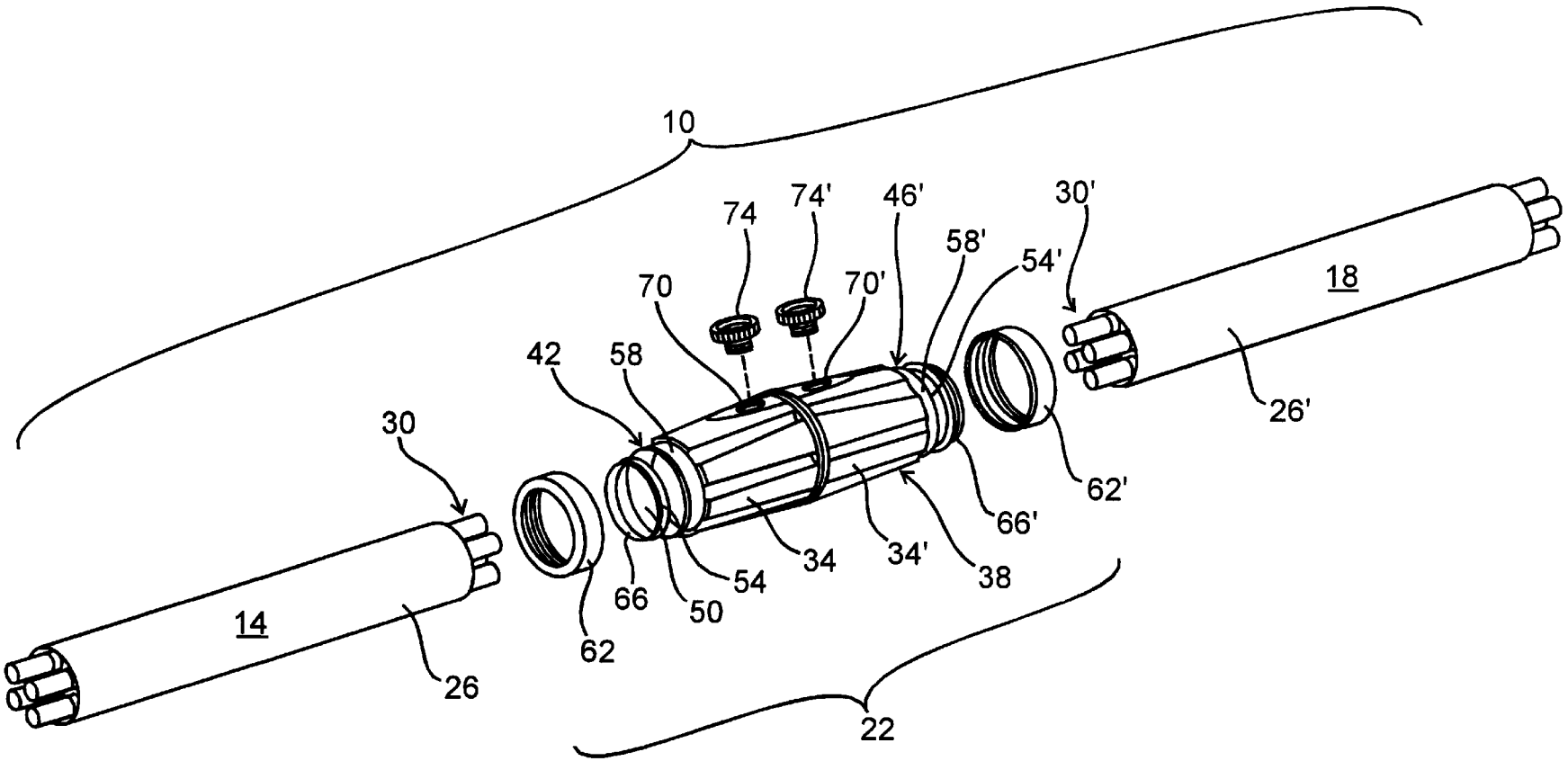
FIG. 2 is an exploded view of the sectionalized electrical distribution system of FIG. 1.

Referring now to FIG. 2, the connecting device 22 of the present invention is preferably made from two identical halves 34 and 34' which together form a generally cylindrical housing 38 having a first end 42, a second end 46, and further defining a passage 50 connecting the first and second ends, 42 and 46, respectively. The first and second ends, 42 and 46, respectively, define generally circular openings 54 and 54' for the passage 50. The openings 54 and 54' are dimensioned to snugly receive the generally tubular housings 26 and 26'. The first and second ends 42 and 46 have an externally threaded portion 58 and 58' for receiving compression nuts 62 and 62' that provide a mechanical connection between the housings 26 and 26' and the connector housing 38. A compressible sealing gland 66 and 66' is provided at each nut, 62 and 62', respectively, for sealing the connection between the tubular housings 26 and 26' and the connector housing 38 against the ingress of moisture. Each of the housing halves 34 and 34' is provided with an access opening, 70 and 70', respectively, which is closed by a closing cap 74 and 74'. The closing cap 74/74' can be retained by threads as shown or other suitable means which will seal the housing 38 against the ingress of moisture.

Figure 3:
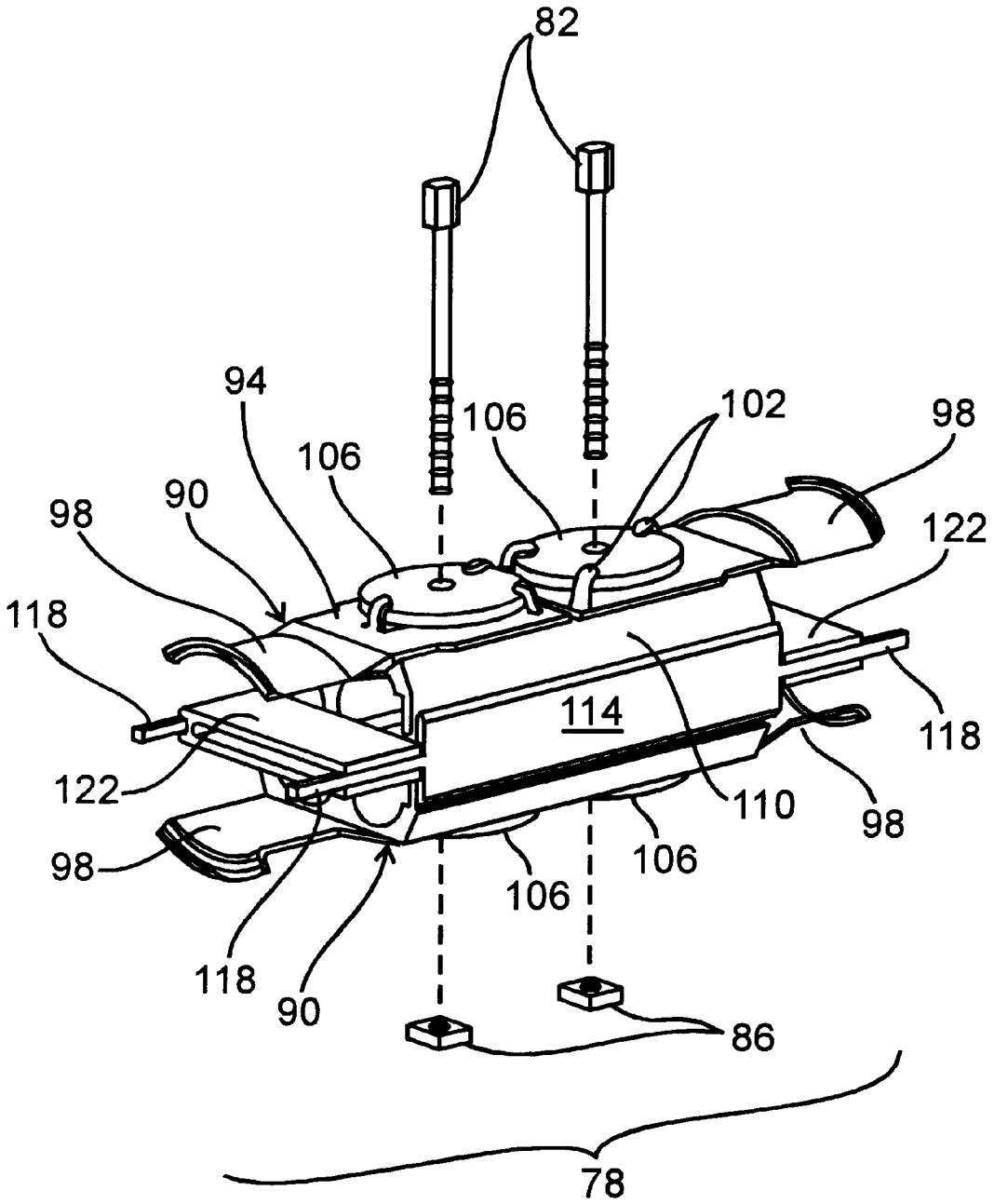
FIG. 3 is an isometric view of the electrical connector assembly in accordance with the present invention.

Referring now to FIG. 3, a connector assembly generally indicated by reference numeral 78 is shown. The assembly 78 is generally rectangular in overall shape with a generally non-circular cross-section, generally octagonal in the preferred embodiment. The connector assembly 78 is loosely held together by connector bolts 82 which pass through the assembly 78 and are threaded into nuts 86. The assembly 78 further includes a pair of ground connectors 90 spaced apart one from the other. The ground connectors 90 are made from an electrically conductive material. Each ground connector 90 is generally rectangular in overall shape and includes a flat portion 94 with extending ends 98. The extending ends 98 are formed such that their cross-sectional shape corresponds generally to the curvature of the tubular housings 26 and 26' of the adjacent first and second sections, 14 and 18 respectively. The extending ends 98 are also spring-like, which allows them to slidingly but forcibly engage the tubular housings 26 and 26' of the adjacent first and second sections 14 and 18 thus making a good electrical connection. This electrical connection between the ground connectors 90 and the housings 26 and 26' of the adjacent sections 14 and 18 provides a continuous system ground path between adjacent sections of the electrical distribution system 10. The connector housing 38 provides a parallel path for ground current since it is electrically connected to the ground connectors 90 at the extending ends 98. Each ground connector 90 also includes a number of integrally formed tabs 102 for retaining spring washers 106 to the ground connectors 90. Located immediately adjacent to and between the flat portions 94 of the ground connectors 90 are a pair of outside insulators 110, also generally rectangular in shape. The outside insulators 110 each include a generally flat surface 112 (see FIG. 4) which interfaces with the flat portions 94 of the ground connectors 90. Located between and loosely interlocked with the outside insulators 110 are a pair of inside insulators 114. The inside insulators 114 of FIG. 3 include a generally rectangular support member 118 extending from each end such that the support members 118 extending from the same end of the two inside insulators 114 are generally parallel and spaced apart from one another. A stop member 122 is slidably received on the parallel support members 118 at each end of the inside insulator 114 such that the stop member 122 lies between the ends 98 of the ground connectors 90. The stop members 122 prevent the adjacent ends of first and second sections, 14 and 18, respectively, from being inserted too far into the passage 50 of the connecting device 22. Preferably, the outside and inside insulators, 110 and 114 respectively, are made from a substantially rigid electrically insulating material, and the stop members 122 are made from an electrically insulating material having some resiliency. The spring washers 106 provide a uniform clamping force over the flat portions 94 of the ground connectors 90 when the bolts 82 are tightened. This uniform force is transferred to the outside insulators 110, thereby producing the clamping force between the outside and inside insulators, 110 and 114, respectively.

Figure 4:
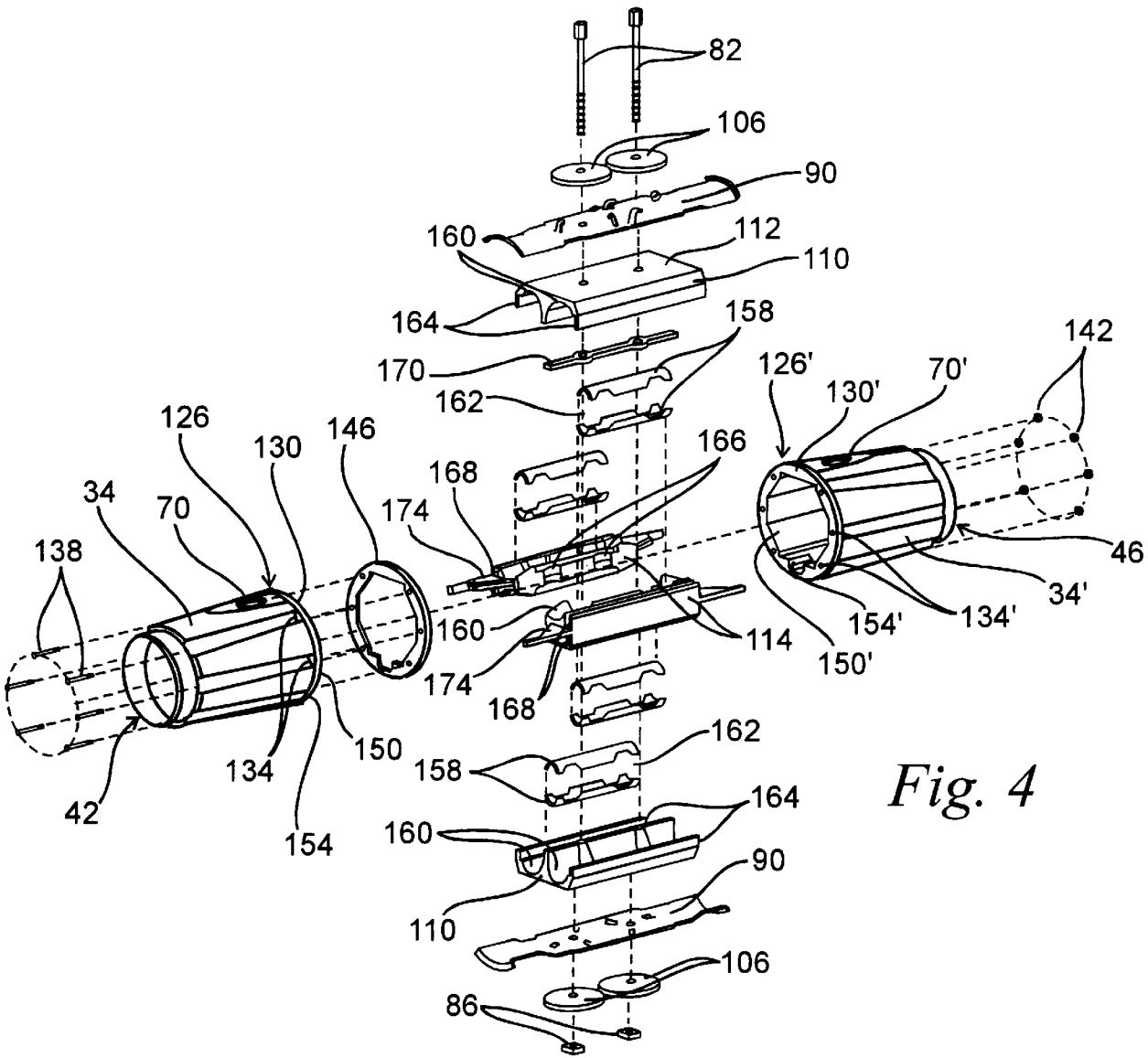
FIG. 4 is an exploded view of the electrical connector device in accordance with the present invention.

Referring now to FIG. 4, the connector 22 is shown in an exploded view. The two identical halves 34 and 34' forming the housing 38 are generally shaped like truncated cones. The small ends of the cones form the first and second housing ends, 42 and 46 respectively. The large ends of the cones form mating ends 126 and 126' at which the two halves 34 and 34' come together. The mating ends 126 and 126' each have a mating surface, 130 and 130', respectively, that is generally perpendicular to the axis of the housing 22. This mating surface 130 is provided with holes 134 and 134' for receiving fastening means such as screws 138 and nuts 142 to provide a means for attaching the two housing halves 34 and 34' securely together. A gasket 146 is placed between the mating surfaces 130 and 130' to provide a moisture resistant seal between the two housing halves 34 and 34' when the fastening means are securely tightened. The mating ends 126 and 126' also define generally non-circular openings 150/150', respectively, which correspond to the generally non-circular cross-sectional shape of the connector assembly 78 such that the connector assembly 78 is slidably received in the openings 150 and 150'. When the connector 22 is assembled, one half of the connector assembly 78 is enclosed in each of the two halves 34 and 34'. Each of the halves 34 and 34' also includes a nut retaining slot, 154 and 154', respectively, located opposite the access openings 70/70'. The nut retaining slots 154/154' slidably receive the nuts 86 as the connector assembly 78 is received into the housing halves 34 and 34'. The nut retaining slots 154/154' prevent the nuts 86 from turning as the bolts 82 are tightened. When the housing halves 34 and 34' have been assembled about the connector assembly 78, the heads of the bolts 82 will be in alignment with the access openings 70 and 70' such that the bolts 82 can be tightened to make the electrical connection between the adjacent first and second sections, 14 and 18, respectively, of the electrical distribution system 10.

The electrical connection between the electrical conductors 30 and 30' of the first and second sections, 14 and 18, respectively, is made by a number of electrical connectors 158, each made from an electrically conductive material and having a generally semi-circular cross-section corresponding to the cross-sectional shape of the electrical conductors 30/30'. The electrical connectors 158 are arranged in opposed pairs, thus forming generally tubular shaped pockets 162 between the opposed pairs of connectors 158. Each pocket 162 has a longitudinal axis parallel to the axis of the connector assembly 78. Each pocket 162 receives an end of one of the electrical conductors 30 from the first section 14 and an end of one of the electrical conductors 30' from the second section 18. Each electrical conductor 30 of the first section 14 sharing a pocket 162 with an electrical conductor 30' of the second section 18 will be electrically connected one to the other by the opposed pair of electrical connectors 158, forming that pocket 162 when the bolts 82 are tightened.

One electrical connector 158 of each of the opposed pairs of electrical connectors 158 is associated with one of the outside insulators 110, while the other electrical connector 158 of each of the opposed pairs of electrical connectors 158 is associated with one of the inside insulators 114. The outside and inside insulators, 110 and 114, respectively, include a number of longitudinal grooves 160, each having a cross-sectional shape corresponding generally to the semi-circular cross-section of the electrical connectors 158. One electrical connector 158 is associated with or fixedly attached within each of the grooves 160. The outside and inside insulators, 110 and 114, respectively, are arranged such that each has an equal number of grooves 160. The grooves 160 of the outside insulators 110 are generally parallel to one another and are located on a surface opposite the flat surface 112. The grooves 160 of the inside insulators 114 are located on opposite surfaces and are diametrically opposed. Each groove 160 on one of the outside insulators 110 has a corresponding groove 160 on one of the inside insulators 114. The corresponding grooves 160 of the outside and inside insulators, 110 and 114, respectively, are in opposed relationship, thus permitting one opposed pair of electrical connectors 158 to be received between the outside and inside insulators, 110 and 114. The longitudinal alignment between corresponding grooves 160 is maintained by loosely interlocking the outside and inside insulators, 110 and 114, respectively, together. This interlocking is accomplished by a pair of generally parallel aligning ribs 164 extending outwardly from the longitudinal edges each of the outside insulators 110 and a pair of diametrically opposed aligning slots 168 extending along a longitudinal edge of each of the inside insulators 114. One of the diametrically opposed aligning slots 168 of each of the inside insulators 114 receives the aligning ribs 164 of one of the outside insulators 110, while the other of the diametrically opposed aligning slots 168 of each of the inside insulators 114 receives the aligning ribs 164 of the other of the outside insulators 110.

The inside insulators 114 each include a bolt relief 166 for each bolt 82. The bolt reliefs 166 are generally semicircular in shape such that a circular opening for each bolt 82 is provided between the two inside insulators 114 when the connector assembly 78 is complete. A spacer gasket 170 is dimensioned to fit between the two inside insulators 114. The spacer gasket 170 maintains proper spacing between the two inside insulators 114 and is preferably made from an electrically insulating material such that it also provides electrical spacing between live components of different polarity within the connector assembly 78. The inside insulator 114 of FIG. 4 includes an integrally formed stop member 174 at each end. The integrally formed stop member 174 performs the same function as the stop member 122 of FIG. 3 and therefore eliminates the need for two extra parts in the connector assembly 78.

Figure 5:
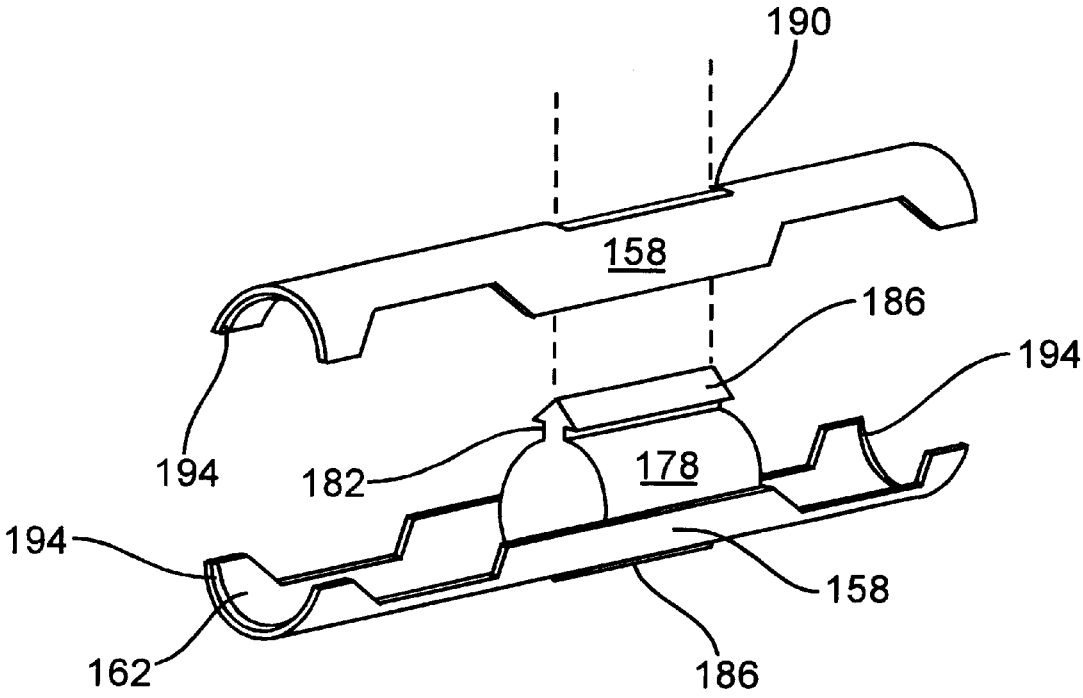
FIG. 5 is an isometric view of a pair of corresponding electrical connectors and an intermediate connector spacer in accordance with the present invention.

Referring now to FIG. 5, a pair of corresponding connectors 158 are shown with a connector spacer 178 which provides proper spacing between the corresponding connectors 158 and further provides a means for holding the corresponding connectors together. The connector spacer 178 is dimensioned to maintain a space approximately equal to the diameter of the electrical conductors 30 and 30' between the corresponding connectors 158. The connector spacer 178 is also provided with two diametrically opposed attaching ribs 182, each extending outward from the connector spacer 178 along its longitudinal axis and terminating at a retaining end 186 that is generally triangular in cross-section, the base of the triangle being wider than the rib 182. Each attaching rib 182 is received within a slot 190 in the connector 158. The slot 190 is dimensioned to be slightly narrower than the base of the triangular shaped retaining end 186 but wider than the rib 182. As the retaining end 186 is pushed through the slot 190, the base of the triangular retaining end locks the connector spacer 178 in place. The connector spacer 178 holds the two corresponding connectors 158 together while also providing the proper spacing between the corresponding connectors 158. The connector spacer 178 is preferably made from an easily compressible material that also has elastic qualities, for example rubber. Each connector 158 has a beveled leading edge 194 at each end to facilitate the installation of the conductors 30 and 30' into the pockets 162.

Figure 6:
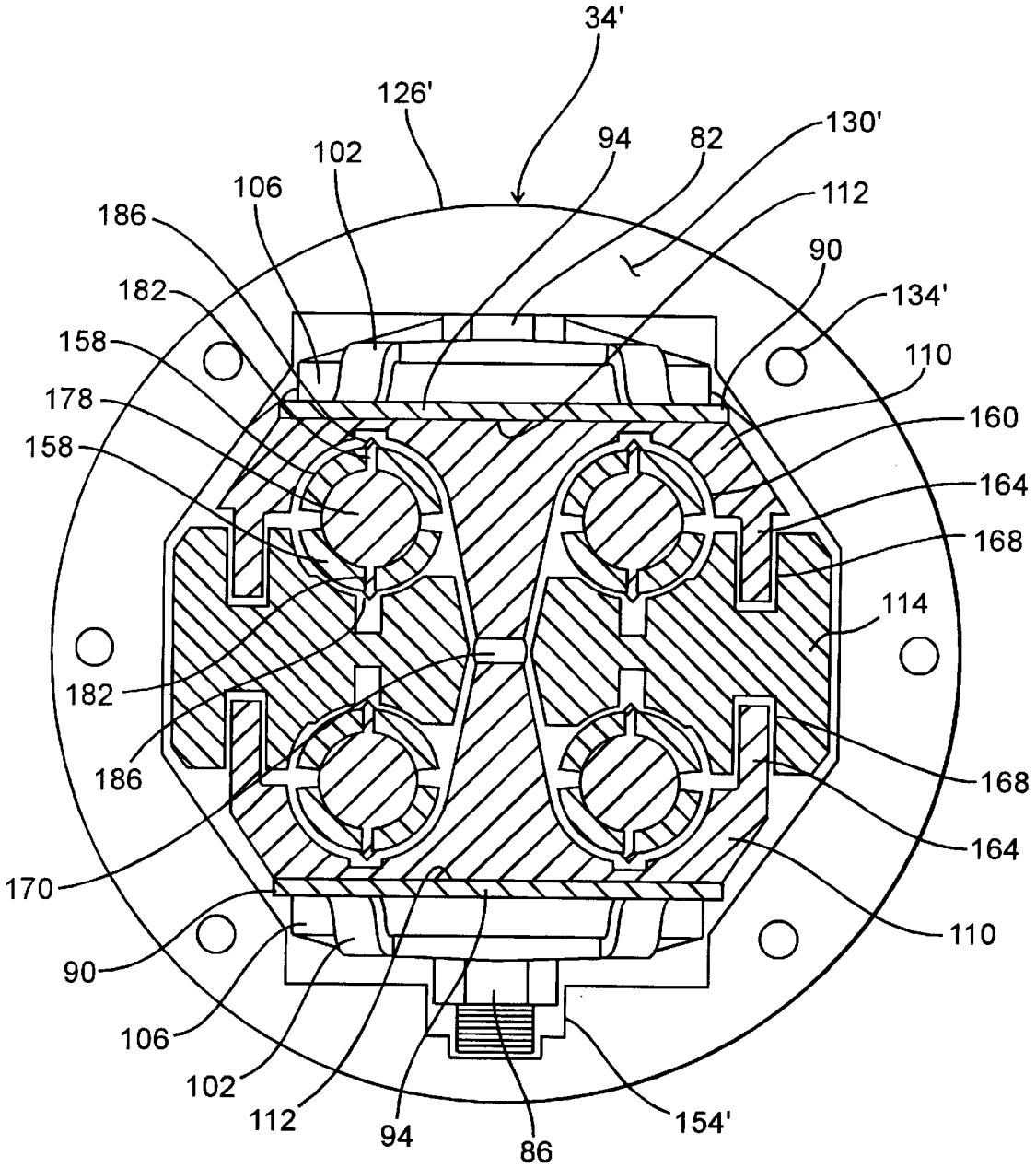
FIG. 6 is a cross-section view taken along lines 6—6 of FIG. 2.

Referring now to FIG. 6, a cross-sectional view of an assembled connecting device 22 provides greater detail of certain features of the connector assembly 78 of FIG. 5. The connector assembly 78, with its non-circular cross-sectional shape, is shown with respect to the non-circular opening 150' of the connector housing 38 mating end 126'. The interlocked aligning ribs 164 and slots 168 which provide the loose interlocking of the outside and inside insulators, 110 and 114, respectively, are easily seen in this view. The retaining ends 186 of the connector spacer 178 are shown engaging the connectors 158 through the slots 190. The spacing gasket 170 is also shown in its position between the inside insulators 114.

What is claimed is:

1. A device for electrically connecting the electrical conductors of a first section of a multi-phase electrical distribution system to the electrical conductors of an adjacent second section of the multi-phase electrical distribution system, said device comprising:

a housing, having a first end and a second end and defining a passage for communicating between said first and second ends, said first and second ends dimensioned to slidably receive a portion of the first and second sections of the electrical distribution system;

a pair of ground connectors received within said housing, each extending generally between said first and second ends of said housing;

a pair of outside insulators, received within said passage, each extending generally between said first and second ends of said housing and being intermediate said ground connectors;

a pair of inside insulators, received within said passage, each extending generally between said first and second ends of said housing and being intermediate said outside insulators, said inside insulators being in juxtaposed position;

a plurality of electrical connectors, each generally semicircular in cross-section and extending generally between said first and second ends of said housing, said electrical connectors arranged in opposed pairs, each said pair being intermediate one of said outside insulators and one of said inside insulators, each said opposed pair being spaced apart by a compressible spacer such that a particular distance is maintained between said opposed pair thus forming a pocket for receiving one electrical conductor from each of the first and second adjacent sections of the electrical distribution system; and means for moving said outside insulators between a first position and a second position with respect to said inside insulators.

2. The connecting device of claim 1 wherein means for moving is a threaded fastener such as a bolt.

3. The connecting device of claim 1 wherein in said first position the electrical conductors of the adjacent first and second sections of the electrical distribution system can enter said pockets at said first end and second ends of said housing, and in said second position the electrical conductors received within said pockets are tightly clamped such that conductors sharing a common pocket are electrically connected together by said corresponding electrical connectors forming said common pocket.

4. The connecting device of claim 1 wherein each of said outside and said inside insulators includes an equal number of semi-circular longitudinal grooves each having a semi-circular cross-section corresponding to said semi-circular cross-section of said electrical connectors, each said groove in one of said outside insulators having a corresponding longitudinally aligned groove in one of said inside insulators, said grooves being opposed such that one said opposed pair of electrical connectors can be receiving between each of said corresponding opposed grooves.

5. The connecting device of claim 4 wherein said outside and said inside insulators further include means for longitudinal alignment to maintain longitudinal alignment of said grooves.

6. The connecting device of claim 5 wherein said means for longitudinal alignment includes a longitudinal aligning rib extending outwardly from each longitudinal edge of each said outside insulator and a pair of longitudinal aligning slots in opposed relationship to one another and extending along a longitudinal edge of each said inside insulator, said aligning slots in each said inside insulator loosely receiving one aligning rib from each said outside insulator.

7. The connecting device of claim 1 wherein said particular distance corresponds to a cross-sectional dimension associated with the electrical conductors of the first and second sections of the electrical distribution system.

8. The connecting device of claim 1 wherein said compressible spacer is attached to each of said opposed electrical connectors forming one said pocket.

9. The connecting device of claim 8 wherein said compressible spacer is compressed as said outside insulators are moved from said first position to said second position.

10. The connecting device of claim 1 further including a plurality of stop members for limiting the distance each of the first and second sections of the electrical distribution system can enter said first and second ends of said housing.

11. The connecting device of claim 10 wherein each said stop member is slidably received on a pair of stop supports, one said stop support extending outwardly from each end of each of said inside insulators.

12. The connecting device of claim 10 wherein each said stop member is integrally formed from said inside insulators.

13. The connecting device of claim 1 wherein said first and second housing ends further include a threaded portion for receiving a compression nut, said compression nuts providing a positive connection between the first and second sections of the electrical distribution system and said connecting device housing.

14. A device for electrically connecting the electrical conductors and conductive housing of a first section of a multi-phase sectionalized electrical distribution system to the electrical conductors and conductive housing of an adjacent second section of the multi-phase sectionalized electrical distribution system, said device comprising:

a housing, having a first end and a second end and defining a passage for communicating between said first and second ends, said first and second ends dimensioned to slidably receive a portion of the first and second sections of the electrical distribution system;

a pair of ground connectors received within said housing such that they extend generally between said first and second ends of said housing thereby engaging the conductive housings of the first and second sections of the electrical distribution system;

a pair of outside insulators, received within said passage such that they extend generally between said first and second ends of said housing and are intermediate said ground connectors;

a pair of inside insulators, received within said passage such that they extend generally between said first and second ends of said housing, each said inside insulator having a stop support extending from each end, said inside insulators being juxtaposed and intermediate said outside insulators;

a stop member for limiting the distance each of the first and second sections of the electrical distribution system can enter said first and second ends of said housing and said stop member being slidably received on a pair of stop supports at each end of said pair of inside insulators;

a plurality of electrical connectors, each generally semi-circular in cross-section and extending generally between said first and second ends of said housing, each said electrical connector being attached to each of said inside or outside insulators, an equal number of said electrical connectors being attached to each of said outside and said inside insulators such that each said electrical connector attached to one of said outside insulators has a corresponding electrical connector attached to one of said inside insulators, said corresponding electrical connectors being opposed thus forming a pocket between said corresponding electrical connectors, each said pocket selectively receiving one electrical conductor from each of the first and second adjacent sections of the electrical distribution system; and means for moving said outside insulators between a first position wherein conductors of the first and second section of the electrical distribution system can enter said pockets and a second position wherein the conductors of both the first and second sections are tightly clamped in said pockets such that conductors of the first and second sections sharing a common pocket are electrically connected together by said corresponding electrical connectors forming said common pocket.

15. The connecting device of claim 14 wherein means for moving is a threaded fastener such as a bolt.

16. The connecting device of claim 14 wherein each of said outside and said inside insulators includes an equal number of semi-circular longitudinal grooves, each said groove receiving one of said semi-circular electrical connectors.

17. The connecting device of claim 16 wherein said outside and said inside insulators further include means for longitudinal alignment to maintain longitudinal alignment of said grooves.

18. The connecting device of claim 17 wherein said means for longitudinal alignment includes a longitudinal aligning rib extending outwardly from each longitudinal edge of each said outside insulator and a pair of longitudinal aligning slots in opposed relationship to one another and extending along a longitudinal edge of each said inside insulator, said aligning slots in each said inside insulator loosely receiving one aligning rib from each said outside insulator.

19. The connecting device of claim 14 wherein each said stop member is integrally formed from said inside insulators.

20. The connecting device of claim 14 wherein said first and second housing ends further include a threaded portion for receiving a compression nut, said compression nuts providing a positive connection between the first and second sections of the electrical distribution system and said connecting device housing.

* * * * *